US005291711A

United States Patent [19]

Kopaz

[11] Patent Number: 5,291,711

[45] Date of Patent: Mar. 8, 1994

[54] INNOVATIVE BUILDING BLOCKS

[76] Inventor: Anton G. Kopaz, 2020 Bayside Pkwy., Ft. Myers, Fla. 33902

[21] Appl. No.: 972,769

[22] Filed: Nov. 6, 1992

[51] Int. Cl.[5] ..... E04C 3/30

[52] U.S. Cl. ..... 52/503; 52/564

[58] Field of Search ..... 52/586, 589, 595, 503, 52/286, 564, 562, 427, 442

[56] References Cited

U.S. PATENT DOCUMENTS

| | | | |
|---|---|---|---|
| 877,997 | 2/1908 | Henry | 52/503 |
| 1,407,349 | 2/1922 | Levitt | 52/503 |
| 1,722,682 | 7/1929 | Rota | 52/503 |
| 2,041,972 | 5/1936 | Sherwood | 52/503 |
| 3,791,090 | 2/1974 | Kniefel | 52/286 X |
| 4,003,172 | 1/1977 | Pawl | 52/286 X |
| 5,020,289 | 6/1991 | Wrightman | 52/286 X |

FOREIGN PATENT DOCUMENTS

| | | | |
|---|---|---|---|
| 173410 | 5/1952 | Austria | 52/286 |
| 492122 | 3/1954 | Italy | 52/503 |

*Primary Examiner*—Rodney M. Lindsey

[57] ABSTRACT

This invention relates to building blocks, and more particularly to building blocks having greater strength in the individual blocks, and which are capable of embodying greater strength between side edges of the blocks. The inside vertical edges of the blocks are slotted with rounded end portions to receive on the inside portions of the wall to provide the contoured side ends of the cross members to provide a strong rigid support, and firm connection between the side members and the connection between the cross pieces. In this way the outer edges of the wall members can be formed smooth with no interruptions except for the side edges of the blocks. Another important aspect of this development is that with respect to a single story construction or even a multistory unit, a single reinforcing metal rod can extend vertically through the center of the wall to anchor the wall at the bottom and at the top in freshly poured concrete to solidify and hold the wall firmly in place, against lateral shifting, it being understood that if desired more than one metal rod can be employed to strengthen the walls at spaced points.

1 Claim, 4 Drawing Sheets

INNOVATIVE BUILDING BLOCKS

BACKGROUND OF THE INVENTION

Heretofore it has been an accepted custom to build buildings and other structures of blocks or bricks. By that construction the walls were not as strong as was desired.

By the use of this construction, it is possible to provide a firm connection between the horizontally and vertically extending walls and the cross pieces that connect the side walls together. To achieve this in a way that the units will be securely fastened together, I have found that it is only necessary to put a fresh concrete mixture at the ends of the horizontally and vertically extending rods and slide them into the grooved members of the side walls. When the concrete mixture sets up, it hardens and securely locks the rod members together. If desired the vertically extending rods can be threaded to provide adjustable connections to add adjustability to the fact that the rods can be tightened to permit adjusting the tension of the vertically and horizontally extending rods.

FIELD OF THE INVENTION

From a technical point of view the construction of the building blocks wherein the uniform buildings constructed of blocks, approximately generally the 7½" square blocks that are approximately 15" long have not had the strength or the versatility that has been desired of them in the past. As a result of heavy wind storm or tornadoes, wherein winds up to 150 MPH, the blocks literally came apart, and have caused tremendous damage, particularly in constructions wherein very high so-called sky scrapers have been constructed in congested areas using the ordinary building blocks. I have devised a construction wherein added weight can be installed in the individual blocks, thus providing a stronger construction than has hereto form been possible. When a tall building collapses in a severe wind storm, that on occasion will have winds that exceed 150 miles per hour speed of the wind, and will do tremendous damage as the blocks fall, their eventual landing spot being accelerated by the force of the wind.

By installing on the inside of the blocks, any additional material such for example as sand, gravel and other similar granular material that have weight considerable such for example as dirt.

DESCRIPTION OF THE PRIOR ART

Insofar as is known to me, no one prior to applicant herein has devised a building block wherein of the weight of the block can be increased merely by adding weight increasing materials to provide a stronger and more durable construction than has heretofore been possible. Also another important facet pertains to the addition of color in the material of which the material is constructed to add color. For example, the cement can have the color materials added to the concrete mix.

SUMMARY OF THE INVENTION

Briefly summarized my invention pertains to a construction wherein the blocks of which buildings are constructed are hollow and the material can be added to the inside of the block to increase the weight of the block and its degree of solidness.

The weight adding elements can be added, bearing in mind that it is desirable that the various weight adding elements be uniformly applied over the entire building so that the weight of different portions of the building will be approximately relatively uniform, as the building is constructed.

Also attention should be directed to the fact that it is possible to set up a system whereby the loading of the weight adding materials can be added by controlling the flow of materials by weight to the various blocks to install the weight adding materials uniformly around the entire building. The materials added are powdery materials such as sand. It is possible to install the weight adding materials preferably through apertures formed in the blocks on the inside of the building construction as it is being built. In this way the weight of the blocks can be increased uniformly as the building is erected and there is little danger that it will be subjected to the danger of collapsing because the weight will always be uniformly added as the building progresses.

Another important facet of the material is the fact that in situations where discarded and worn out vehicle tires are chopped up into relatively small pieces, and are mixed with a cementous material to provide a homogeneous solid mixture.

With respect to the various colors the various shades of red, ranging down to and including light pink, can be used, also almond, brown, in various shades, and various shades of other colors, such as blue and gray in various shades.

DESCRIPTION OF THE DRAWINGS

Referring now to the drawings wherein like reference numerals refer to like parts throughout the various views.

DESCRIPTION OF THE PREFERRED EMBODIMENT

Figure 1:
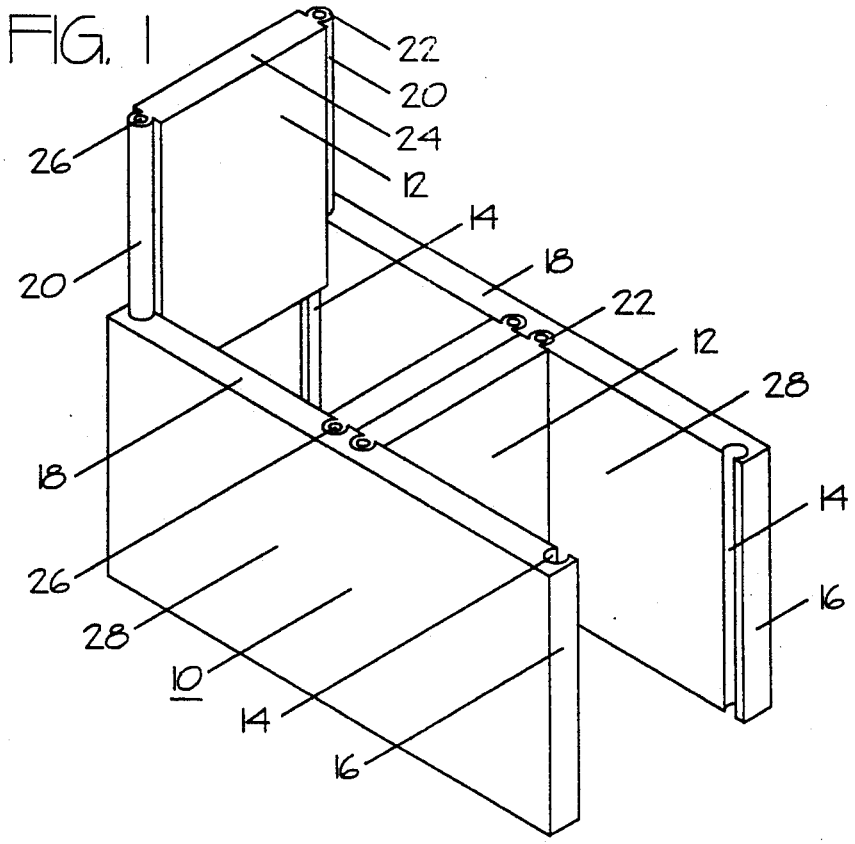
FIG. 1 is a perspective view illustrating a partially assembled block.

Referring now to FIG. 1, building block 10 is illustrated in a perspective view. Building block 10 is comprised of two exterior wall members 28 each having a top 18, a bottom and opposing ends 16. Fashioned into the inner surface of exterior wall member 28 are four internal channel members 14. Internal channel member 14 is predominantly circular in shape and extends from top 18 of exterior wall member to bottom. Internal channel member 14 is such that the width of the opening created is less than the diameter of the chamber. Three internal support members 12 are shown with two completely installed and the rear one partially installed. Internal support member has a top 24 and opposing uniform circular extension 20 having a slightly smaller diameter than the diameter of internal channel 14. As illustrated circular extension 20 fits into internal channel member 14. Circular extension 20 has a top 22. Drilled partially through the center of circular extension 20 is insert bore 26.

Figure 2:
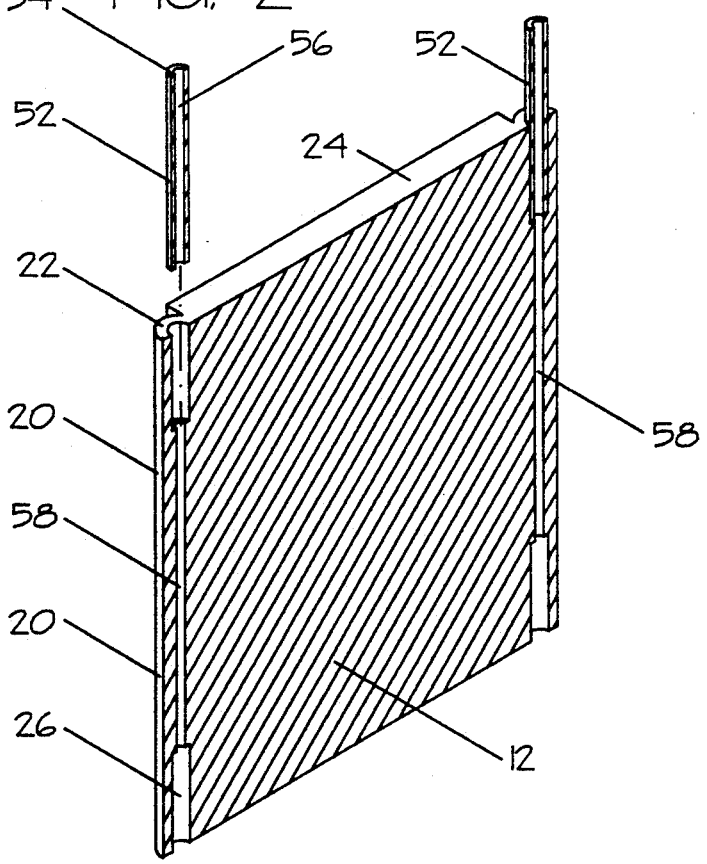
FIG. 2 is a perspective sectional view of an internal support and a circular insert shown with a projection line.

FIG. 2 shows a cutaway perspective view of internal support member 12 and circular insert member 52 as shown with a connecting projection line. Internal support member 12 has a top 24 and opposing circular extension members 20. Each circular extension member 20 has a top 22. Penetrating bore 58 extends complete through circular extension member 20. Aligned with pentrating bore 58 is insert bore 26 having a larger diameter than penetrating bore 58. Circular insert member 52 is shown having an upper surface 54 and a penetrating bore 56. Penetrating bore 56 has a diameter that is relatively equal to penetrating bore 58.

Figure 3:
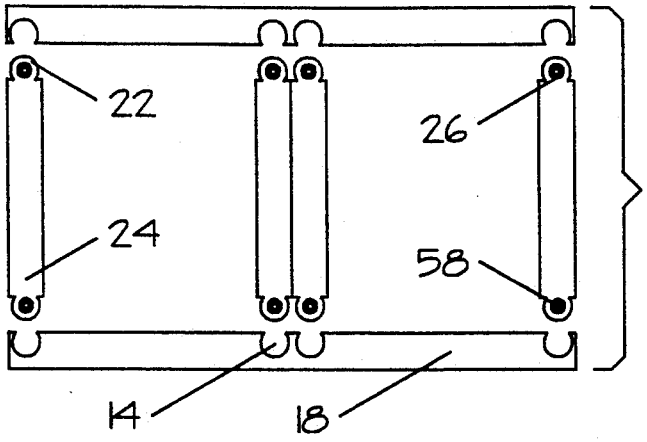
FIG. 3 is an overhead plan view of a non-assembled block.

FIG. 3 is an overhead plan view of a non-assembled building block. Shown are opposing exterior rwall members 18 having internal channel members 14. Also shown are four internal support members having top 24, top of circular extension 22, insert bore 26 and penetrating bore 58.

Figure 4:
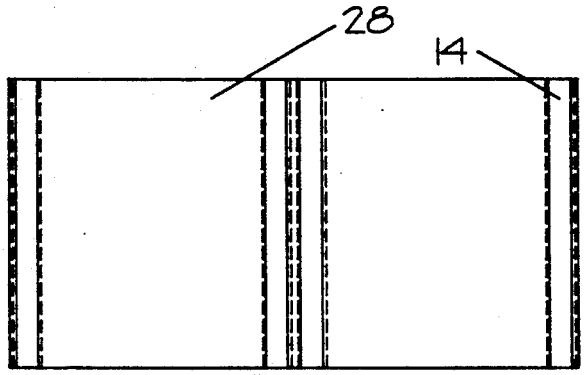
FIG. 4 is a front plan view of a exterior wall member with hidden lines shown.

FIG. 4 shows a front plan view of a exterior wall member 28 having internal channel members 14. Shown are the hidden lines.

Figure 5:
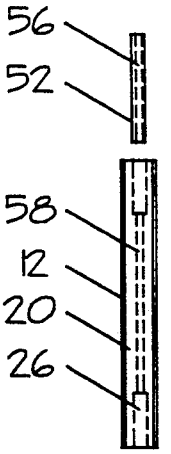
FIG. 5 is a side plan view of an internal support member and a circular insert member with hidden lines shown.

FIG. 5 is a side plan view of an internal support member 12 and a circular insert member 52. Circular extension 20 having insert bore 26 and penetrating bore 58 are shown by hidden lines. Circular insert member 52 is shown having penetrating bore 56.

Figure 6:
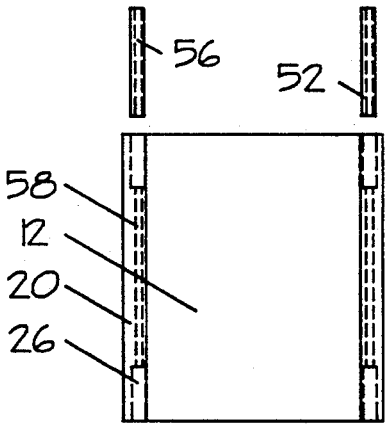
FIG. 6 is a front plan view of an internal support member and a circular insert member with hidden lines shown.

FIG. 6 is a front plan view of an internal support member 12 and a circular insert member 52. Circular extension 20 having insert bore 26 and penetrating bore 58 are shown by hidden lines. Circular insert member 52 is shown having penetrating bore 56.

Figure 7:
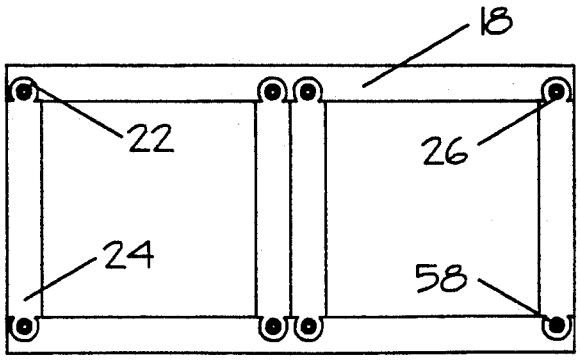
FIG. 7 is a overhead plan view of an assembled block.

FIG. 7 is an overhead plan view of an assembled building block. Shown are opposing exterior wall members 18. Also shown are four internal support members having top 24, top of circular extension 22, insert bore 26 and penetrating bore 58.

Figure 8:
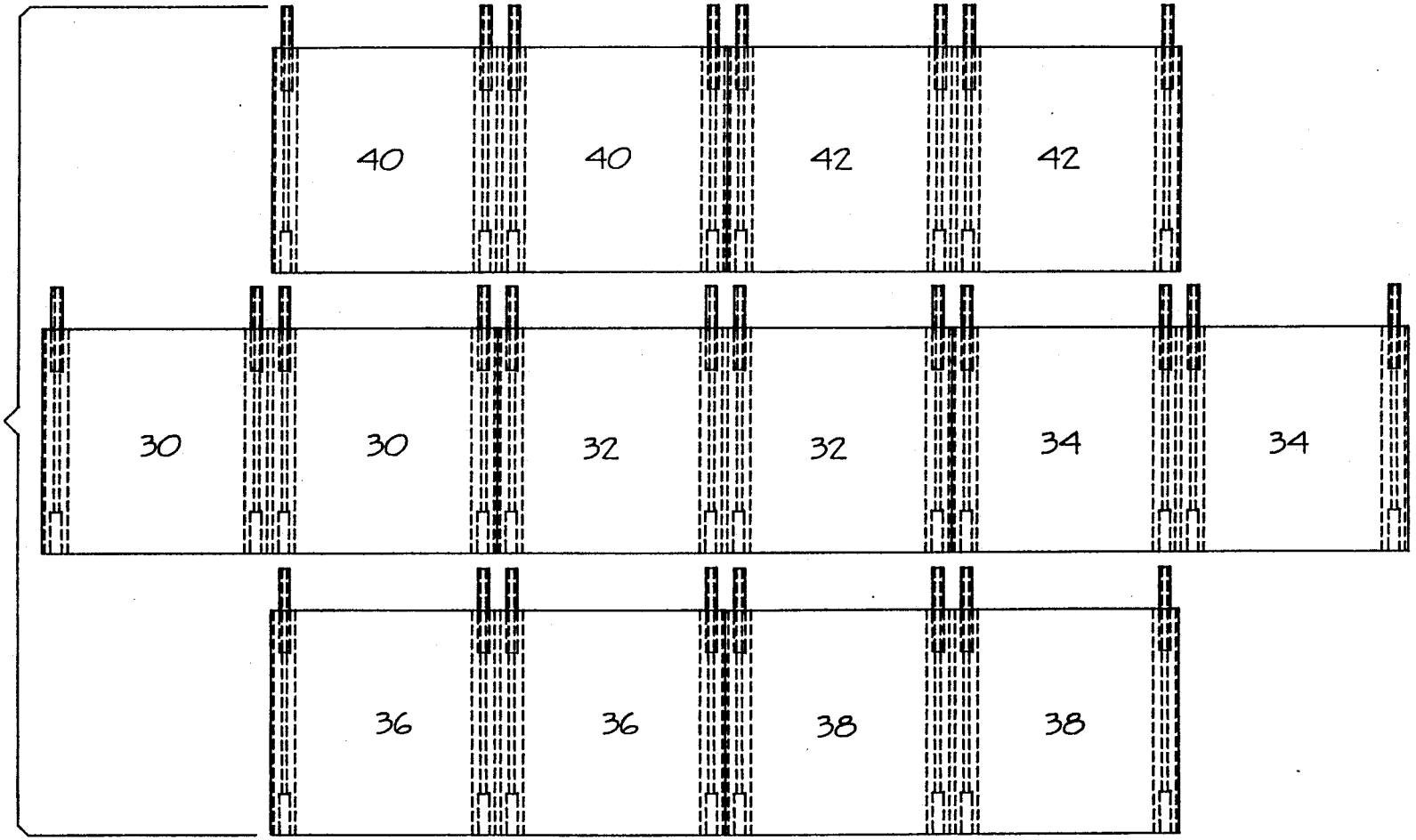
FIG. 8 is a front plan view of 7 blocks with hidden lines shown illustrating proper alignment for use.

FIG. 8 is a front plan view of 7 building blocks illustrating preferred alignment. Bottom row comprising blocks 36 and 38 are shown abutting one another. Shown by use of hidden lines are the various insert bores and the various penetrating bores. Shown elevated above the bottom row is middle row formed by blocks 30, 32 and 34. Shown suspended above the middle row is top row formed by blocks 40 and 42. This view clearly shows the proper alignment of the blocks the circular insert members the insert bores and the penetrating bores in both the internal support members and the circular insert members.

Figure 9:
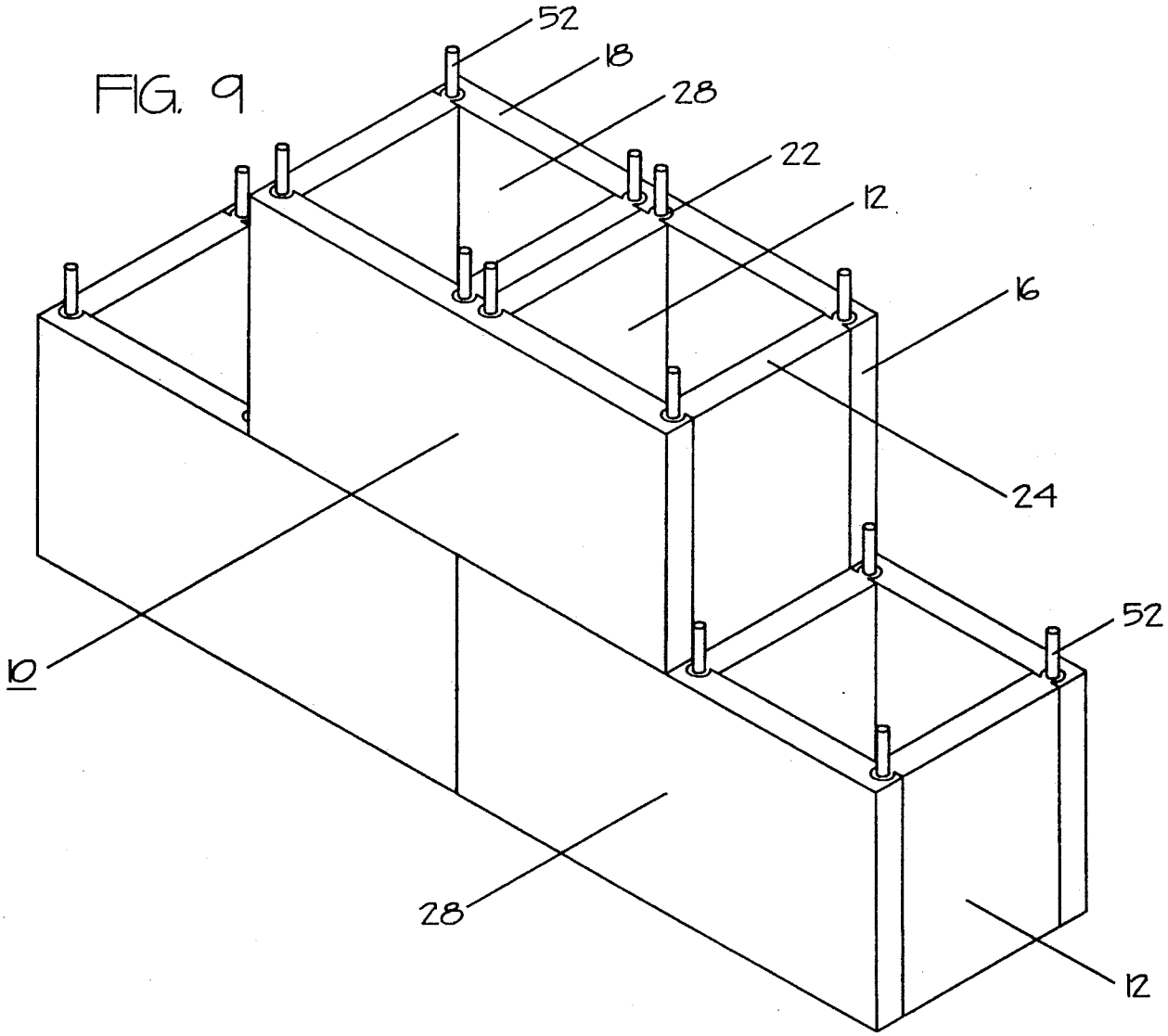
FIG. 9 is a perspective view showing 3 blocks as assembled with circular inserts installed.

FIG. 9 is a perspective view of three building blocks 10 each formed of two exterior wall members 28, four internal support members 12 and eight circular insert members 52. Shown ore end 16 top 24 and top of circular extension 22. This illustration demonstrates the proper alignment and insert placement.

I claim:

1. Building blocks comprising;

A) two exterior wall members having;
  1) an internal surface,
  2) an exterior surface,
  3) a top,
  4) a bottom,
  5) a predetermined height between said top and said bottom,
  6) said predetermined height being approximately 8 inches,
  7) a predetermined length,
  8) said predetermined length being approximately 15 inches,
  9) a predetermined width between said internal surface and said exterior surface,
  10) four internal channel members each comprising;
    a) a circular bore,
    b) said circular bore extending from said top to said bottom,
    c) said circular bore having a predetermined diameter,
    d) an opening formed by said circular bore extending to and penetrating said internal surface of said exterior wall member,
    e) said circular bore extending approximately one half of said width of said exterior wall member,
    f) said opening having a predetermined width being less than said diameter of said circular bore, B) four internal support members each comprising;
  1) a top,
  2) a bottom,
  3) a predetermined height between said top and said bottom,
  4) said height relatively equal to said height of said exterior wall members,
  5) two opposing sides,
  6) a predetermined width between said opposing sides,
  7) two opposing ends,
  8) each of said opposing ends comprising;
    a) a uniform circular extension,
    b) said uniform circular extension having a predetermined diameter,
    c) said diameter being slightly smaller than said diameter of said circular bore of said exterior wall member,
    d) a penetrating bore through said circular extension,
    e) said penetrating bore having a predetermined diameter,
    f) an upper insert bore,
    g) said upper insert bore having a predetermined diameter,
    h) said diameter of said upper insert bore being greater than said diameter of said penetrating bore,
    i) said upper insert bore having a predetermined depth,
    j) said upper insert bore aligned with said penetrating bore,
    k) a lower insert bore,
    l) said lower insert bore having a predetermined diameter,
    m) said diameter of said lower insert bore being greater than said diameter of said penetrating bore,
    n) said lower insert bore having a predetermined height,
    o) said lower insert bore aligned with said penetrating bore, C) a plurality of circular insert members each comprising;

1) a predetermined diameter, 2) said diameter being slightly smaller than said diameter of said upper insert bore and said lower insert bore of said circular extension, 3) a predetermined length, 4) said length being no greater than said depth of said upper insert bore of said circular extension plus said height of said lower insert bore of said circular extension, 5) a insert penetrating bore, 6) said penetrating bore having a predetermined diameter, 7) said diameter being relatively equal to said diameter of said penetrating bore of said circular extension of said internal support member, whereby a plurality of building block would be constructed each using two exterior wall members and four internal support members and the resulting building blocks would be attached to each other using the circular insert members and all of the blocks within a wall could be further reinforced with rods inserted through the aligned penetrating bores.

* * * * *